US007808442B2

(12) United States Patent
Chiu et al.

(10) Patent No.: US 7,808,442 B2
(45) Date of Patent: Oct. 5, 2010

(54) MULTI-BAND ANTENNA

(75) Inventors: Yi-Hung Chiu, Taipei Hsien (TW); Chia-Tien Li, Taipei Hsien (TW)

(73) Assignee: WISTRON NeWeb Corp., Taipei Hsien (TW)

( * ) Notice: Subject to any disclaimer, the term of this patent is extended or adjusted under 35 U.S.C. 154(b) by 0 days.

(21) Appl. No.: 12/129,685

(22) Filed: May 30, 2008

(65) Prior Publication Data

US 2009/0224979 A1 Sep. 10, 2009

(30) Foreign Application Priority Data

Mar. 5, 2008 (TW) ..... 97107723 A

(51) Int. Cl.
*H01Q 1/48* (2006.01)
*H01Q 21/30* (2006.01)

(52) U.S. Cl. ..... 343/826; 343/829; 343/833; 343/846

(58) Field of Classification Search ..... 343/702, 343/833, 846, 700 MS, 826, 828, 829, 831
See application file for complete search history.

(56) References Cited

U.S. PATENT DOCUMENTS 6,650,294 B2 * 11/2003 Ying et al. ..... 343/700 MS
6,812,892 B2 11/2004 Tai et al.
7,256,743 B2 * 8/2007 Korva ..... 343/702

* cited by examiner

*Primary Examiner*—Michael C Wimer
(74) *Attorney, Agent, or Firm*—Pai Patent & Trademark Law Firm; Chao-Chang David Pai

(57) ABSTRACT

The present invention discloses a multi-band antenna. The antenna includes a ground portion, a parasitic unit connecting with the ground portion and operated at a first frequency band, a first radiation portion having a feeding point and operated at a second frequency band, a second radiation portion connecting with the feeding point and operated at a third frequency band. The first radiation portion and the second radiation portion are located between the parasitic unit and the ground portion.

33 Claims, 12 Drawing Sheets

100

MULTI-BAND ANTENNA

RELATED APPLICATIONS

This application claims priority to Taiwan Application Serial Number 97107723, filed Mar. 5, 2008, which is herein incorporated by reference.

FIELD OF THE INVENTION

The present invention relates to an antenna apparatus, and especially to an antenna apparatus that can operate in two or more than two frequency bands.

BACKGROUND OF THE INVENTION

The key development in communication technology has been the transfer from wired to wireless communication. In the field of wireless communication, the signal propagates through the air in the form of electromagnetic waves, where the bridge of the signals between the wireless unit and the air is an antenna. That is to say, wireless communication units need antennas to transmit or receive electromagnetic waves, and they are therefore essential components of wireless communication units.

U.S. Pat. No. 6,812,892 issued on Nov. 2, 2004 discloses a multi-band antenna. As illustrated in FIG. 1, the multi-band antenna 1 comprises a first radiating strip, a second radiating strip 3, a ground portion 5, a connection strip 4 and a coaxial cable 6. The connection strip 4 interconnects the first radiating strip 2 and the second radiating strip 3. The first radiating strip 2, the second radiating strip 3, the ground portion 5 and the connection strip 4 are all disposed in the same plane. The first radiating strip 2 and the connection strip 4 are configured to function as a first planar inverted-F antenna (PIFA) operating in a higher frequency band. The second radiating strip 3 and the connection strip 4 are configured to function as a second PIFA operating in a lower frequency band.

FIG. 2 is a test chart recording for the multi-band antenna of FIG. 1, showing Voltage Standing Wave Ratio (VSWR) as a function of frequency. The bandwidth percentage of the multi-band antenna 1 is 5.7% between 2.39 GHz and 2.53 GHz, which is a narrow bandwidth. Hence, an improved antenna is desired to overcome the above-mentioned shortcomings of existing antennas.

SUMMARY OF THE INVENTION

Therefore, the main purpose of the present invention is to provide multi-band antenna having a wide bandwidth.

In accordance with the foregoing purpose, the present invention discloses a multi-band antenna. The antenna includes a ground portion, a parasitic unit connecting with the ground portion and operated at a first frequency band, a first radiation portion having a feeding point and operated at a second frequency band, a second radiation portion connecting with the feeding point and operated at a third frequency band. The first radiation portion and the second radiation portion are located between the parasitic unit and the ground portion.

In accordance with the foregoing purpose, the present invention discloses a multi-band antenna. The antenna includes a ground portion having a first ground surface and a second ground surface, a parasitic unit connecting with the first side of the second ground surface and operated at a first frequency band, a first radiation portion having a feeding point and operated at a second frequency band, a second radiation portion connecting with the feeding point and a second side adjacent to the first side of the second ground surface and operated at a third frequency band. The second ground surface raises the first radiation portion and the second radiation portion. Therefore, the first radiation portion and the second radiation portion are not located in the same plane with the first ground surface. A cross section constructed by the parasitic unit and the second ground surface has an appearance similar to "U". The projection of the first radiation portion and the second radiation portion is located in the range of the "U".

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
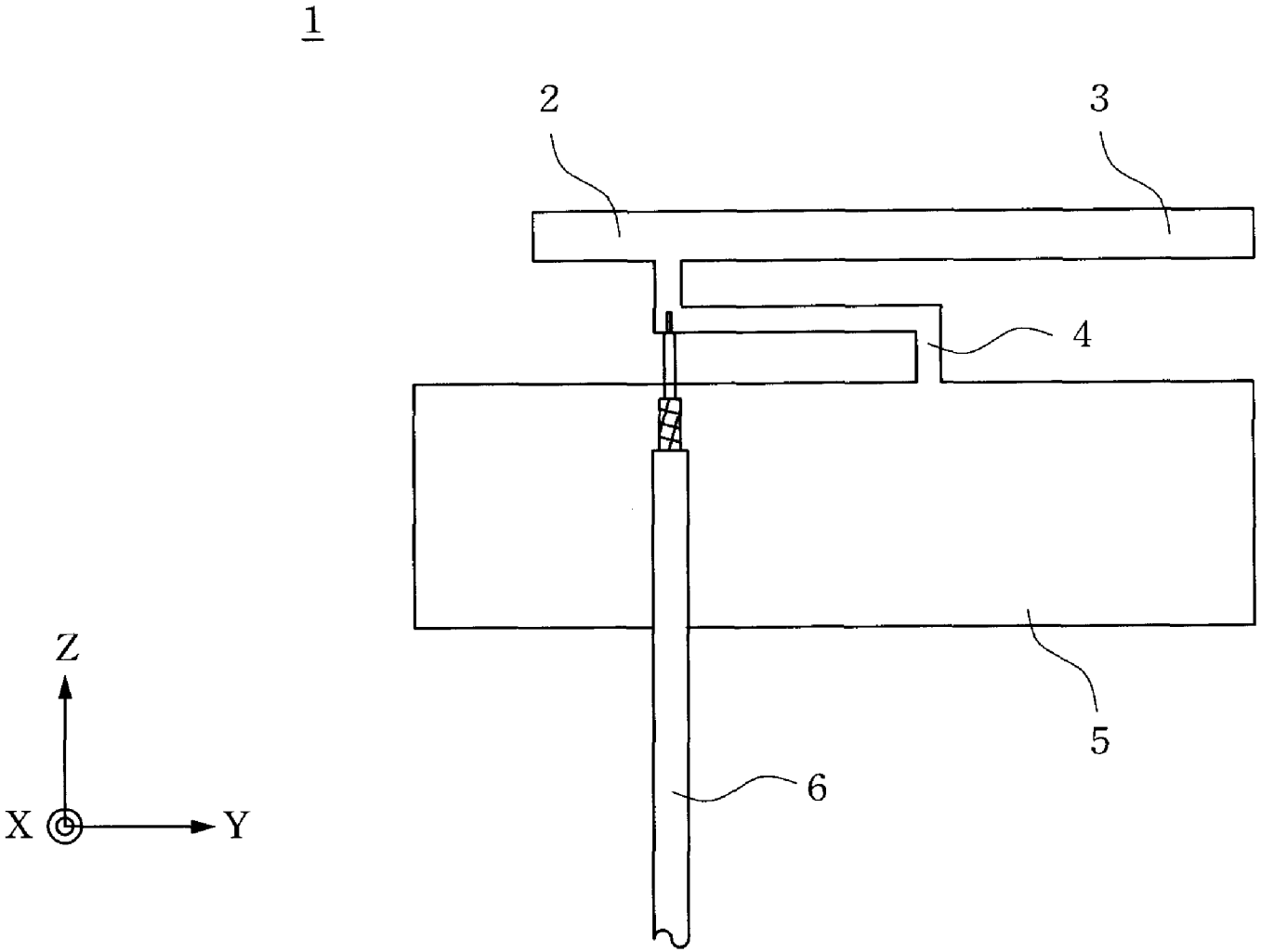
Fig. 1 (Prior Art)
FIG. 1 is a schematic diagram of a typical multi-band antenna.
Figure 2:
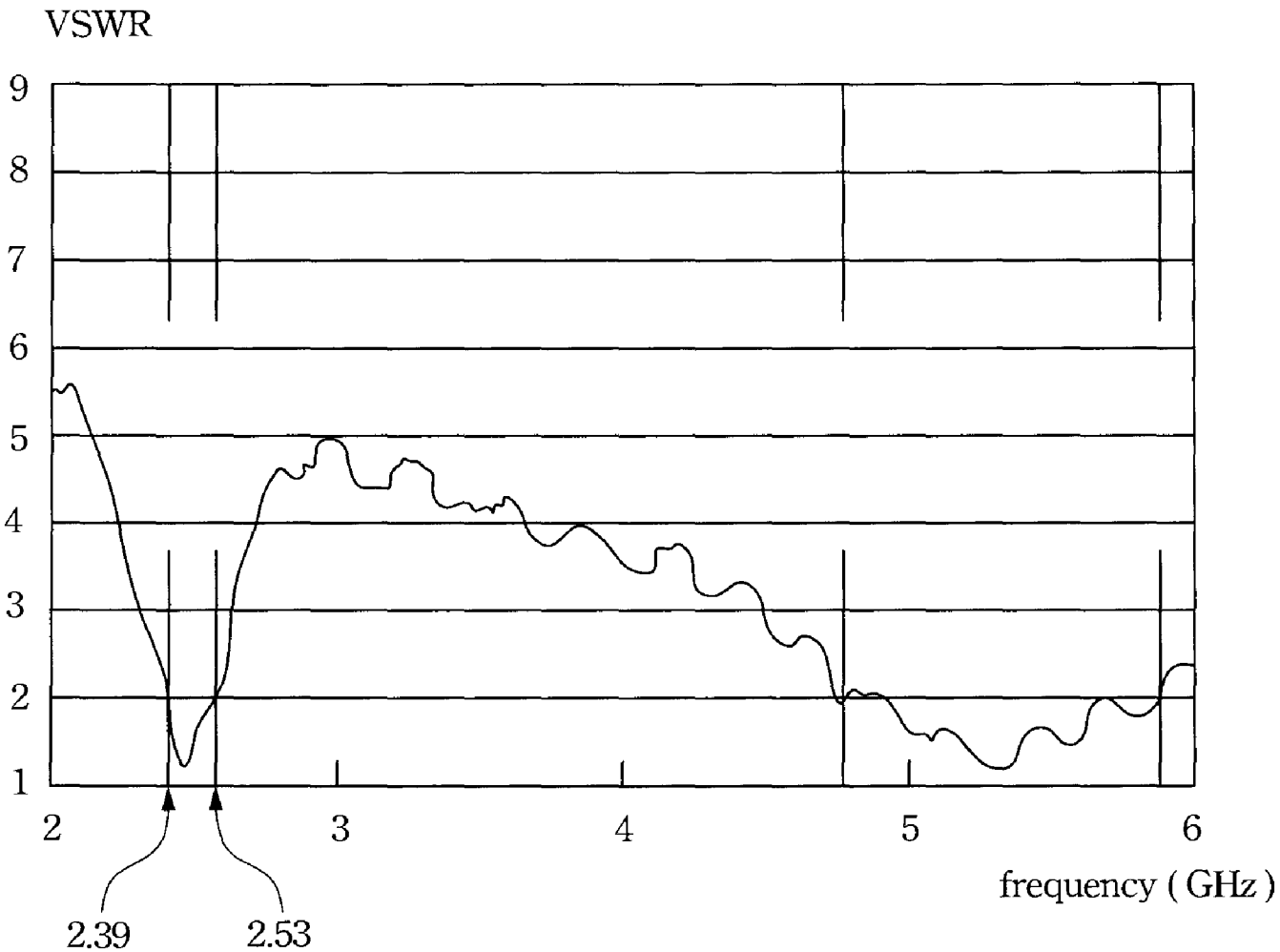
Fig. 2 (Prior Art)
FIG. 2 is a test chart recording for the multi-band antenna of FIG. 1, showing Voltage Standing Wave Ratio (VSWR) as a function of frequency.
Figure 3:
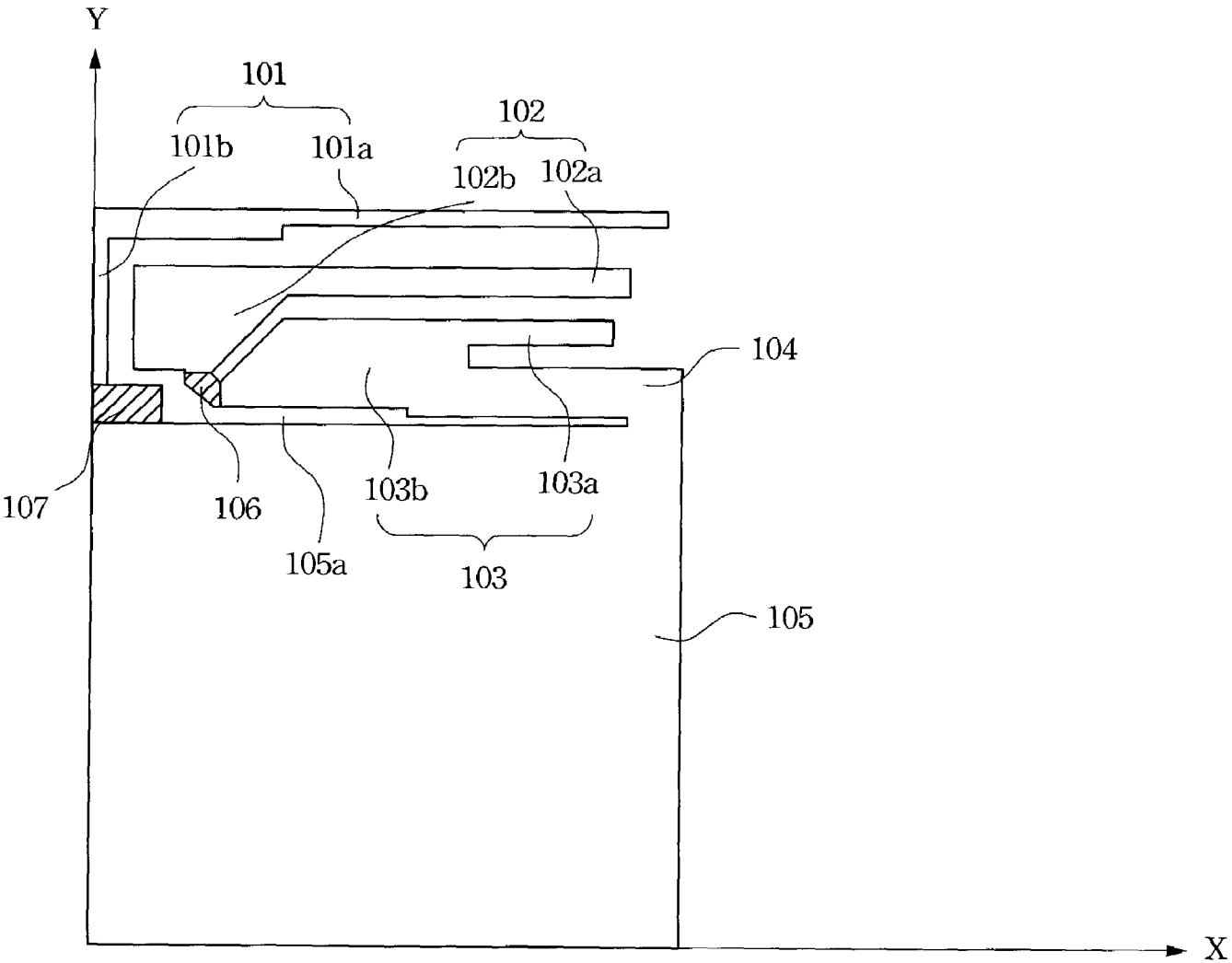
FIG. 3 is a schematic diagram of a multi-band antenna in accordance with a first preferred embodiment of the present invention.

FIG. 3 is a schematic diagram of a multi-band antenna in accordance with a first preferred embodiment of the present invention. The multi-band antenna 100 of the present invention includes a parasitic unit 101, a first radiation portion 102, a second radiation portion 103, a connection unit 104 and a ground portion 105. A ground point 107 disposed in a side 105*a* of the ground portion 105 connects with the parasitic unit 101. Both the first radiation portion 102 and the second radiation portion 103 connect with a feeding point 106.

According to the first embodiment of the present invention, all the parasitic units 101, the first radiation portion 102 and the second radiation portion 103 have strip appearances and are sequentially arranged in the same plane with the ground portion 105. The parasitic unit 101 is outside and connects with the ground point 107. A cross section constructed by the parasitic unit 101 and one side 105*a* of the ground portion 105 has an appearance similar to "U" whose opening is toward a specific direction. The location of the feeding point 106 is in the opening and close to the side 105*a* of the ground portion 105. The first radiation portion 102 is arranged under the parasitic unit 101 and connects with the feeding point 106. The second radiation portion 103 is arranged under the first radiation portion 102 and connects with the feeding point 106. In accordance with an embodiment, the second radiation portion 103 connects to the side 105*a* of the ground portion 105 through a connection unit 104. In other words, the first radiation portion 102 and the second radiation portion 103 are located between the parasitic unit 101 and the side 105*a*.

According to an embodiment, the parasitic unit 101 includes a first part 101*a* and a second part 101*b*. The first part 101*a* is parallel to the side 105*a* and connects with the ground point 107 through the second part 101*b*. In an embodiment, the first part 101*a* is perpendicular to the second part 101*b*. A cross section constructed by the first part 101*a*, the second part 101*b* and side 105*a* has an appearance similar to "U". The first radiation portion 102 includes a third part 102*a* and a fourth part 102*b*. The third part 102*a* is parallel to the side 105*a* and connects with the feeding point 106 through the fourth part 102*b*. The second radiation portion 103 includes a fifth part 103*a* and a sixth part 103*b*. The fifth part 103*a* is parallel to the side 105*a* and connects with the feeding point 106 through the sixth part 103*b*. The fifth part 103*a* connects with the side 105*a* through the connection unit 104.

Figure 4:
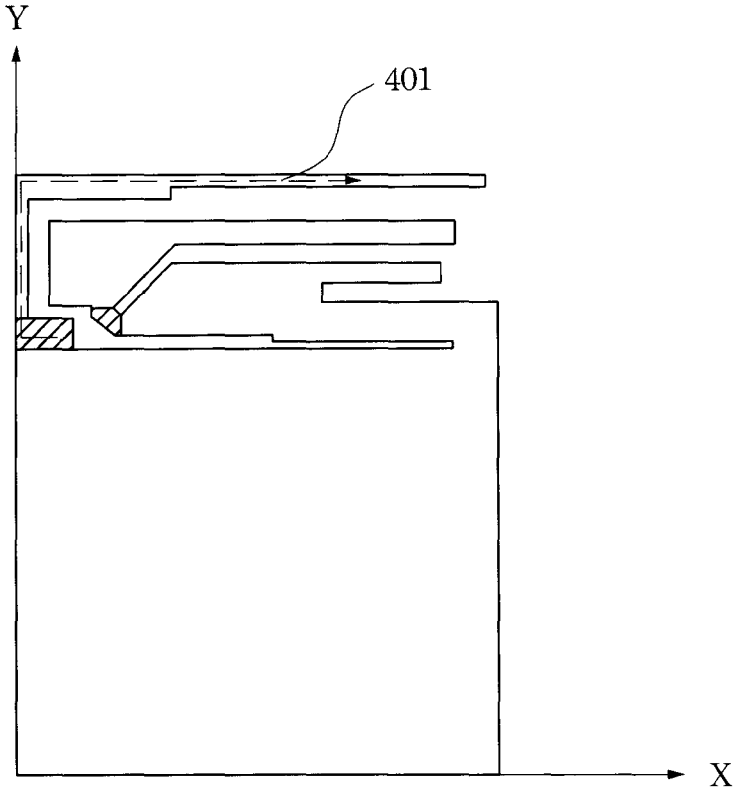
FIG. 4 illustrates a circuit route in the parasitic unit.
Figure 5:
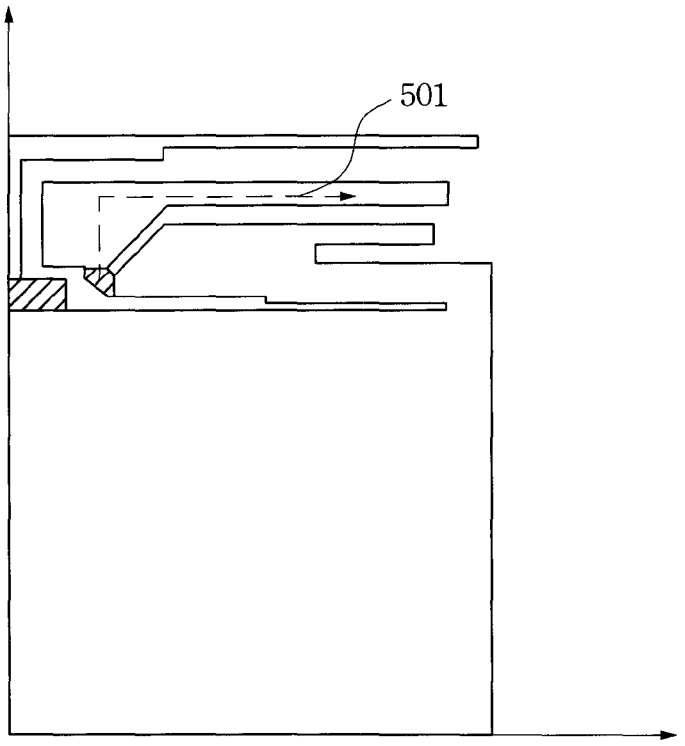
FIG. 5 illustrates a circuit route in the first radiation portion.
Figure 6:
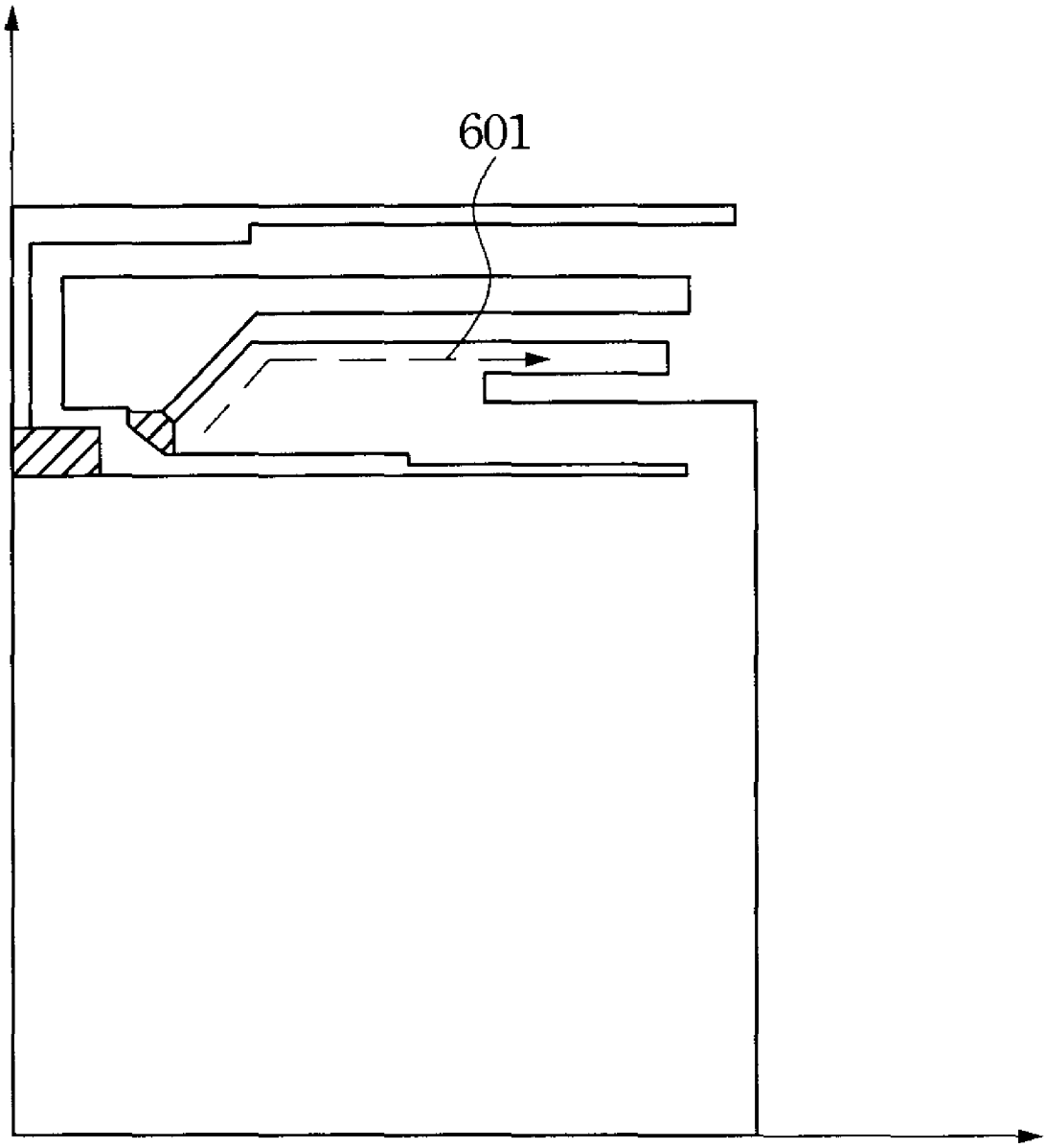
FIG. 6 illustrates a circuit route in the second radiation portion.

The feeding point 106 and the ground point 107 connects with a coaxial cable (not shown in the figure). The feeding point 106 connects with the inner copper core of the coaxial cable. The ground point 107 connects with copper screen of the coaxial cable. Current is fed into the first radiation portion 102 and the second radiation portion 103 from the inner copper core through the feeding point 106. The current is fed to the parasitic unit 101 through the ground portion 105 and the ground point 107. FIG. 4 to FIG. 6 illustrate these circuit routes in the parasitic unit, the first radiation portion 102 and the second radiation portion 103 respectively. As illustrated in FIG. 4 to FIG. 6, these current routes 401, 501 and 601 have same current direction toward the opening. Therefore, these fed currents are not offset to each other.

According to the present invention, the parasitic unit 101 operates at lower frequency band. The first radiation portion 102 operates at a middle frequency band. The second radiation portion 103 operates at a higher frequency band. Accordingly, when the multi-band antenna 100 operates in WiMAX communication system, the parasitic unit 101 operates at a frequency band between 2.3 GHz and 2.7 GHz, the first radiation portion 102 operates at a frequency band between 3.3 GHz and 3.8 GHz and the second radiation portion 103 operates at a frequency band between 5.15 GHz and 5.85 GHz. In other embodiments, the frequency bands of the parasitic unit 101 and the first radiation portion 102 can be changed by varying their sizes.

Figure 7:
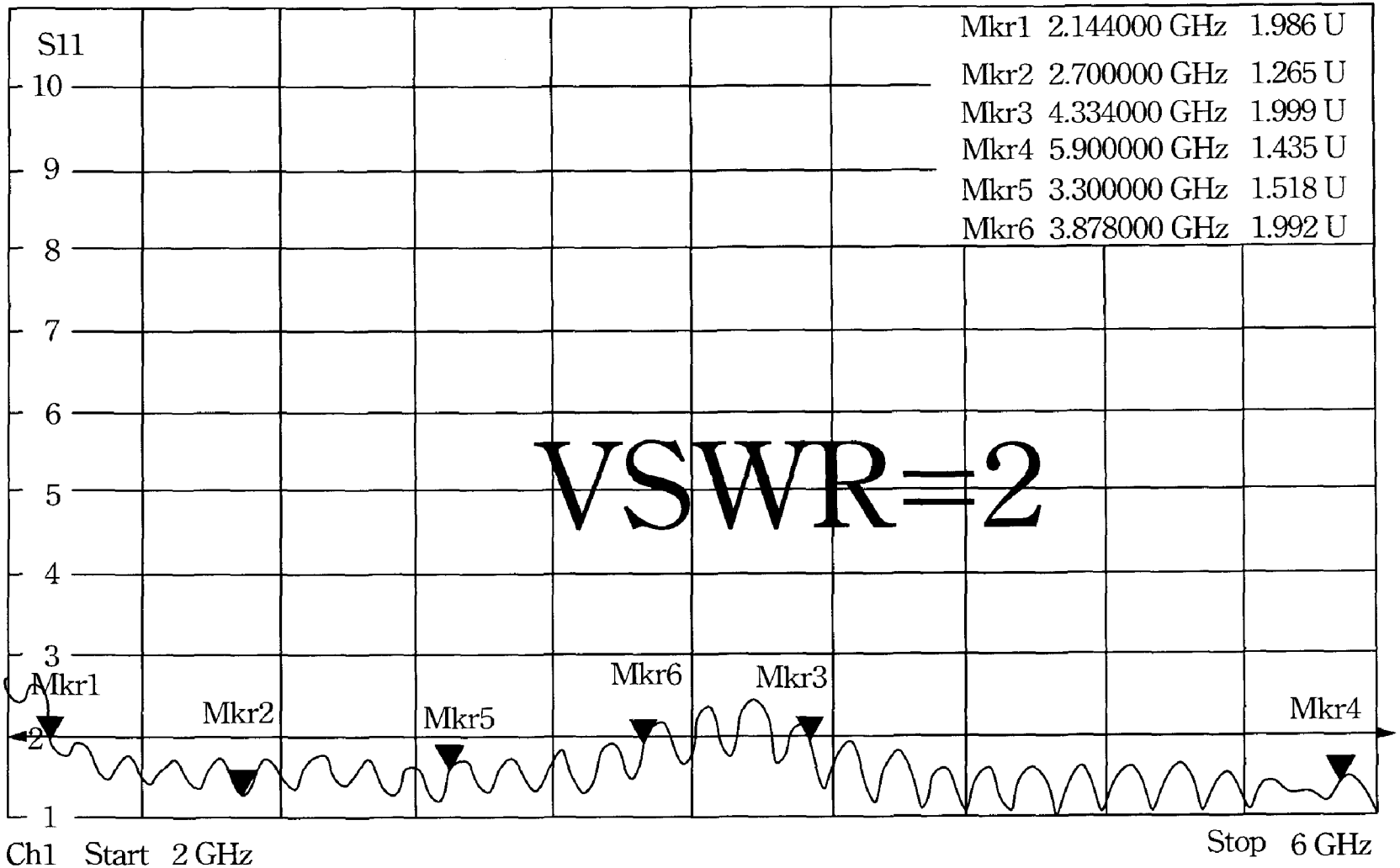
FIG. 7 is a test chart recording for the multi-band antenna of the present invention, showing Voltage Standing Wave Ratio (VSWR) as a function of frequency.

On the other hand, the parasitic unit 101 can resonate with the first radiation portion 102. Therefore, the frequency bands of the parasitic unit 101 and the first radiation portion 102 can be merged together to form a wider frequency band by modifying the size of the parasitic unit 101 and/or the first radiation portion 102. Accordingly, the multi-band antenna 100 operates at two frequency bands. FIG. 7 is a test chart recording for the multi-band antenna 100 of the present invention, showing Voltage Standing Wave Ratio (VSWR) as a function of frequency. In this embodiment, the middle frequency band and the low frequency band are merged together to form a wider frequency band from 2.144 GHz to 3.878 GHz. The bandwidth percentage of the multi-band antenna 100 is 57.7%.

Figure 8:
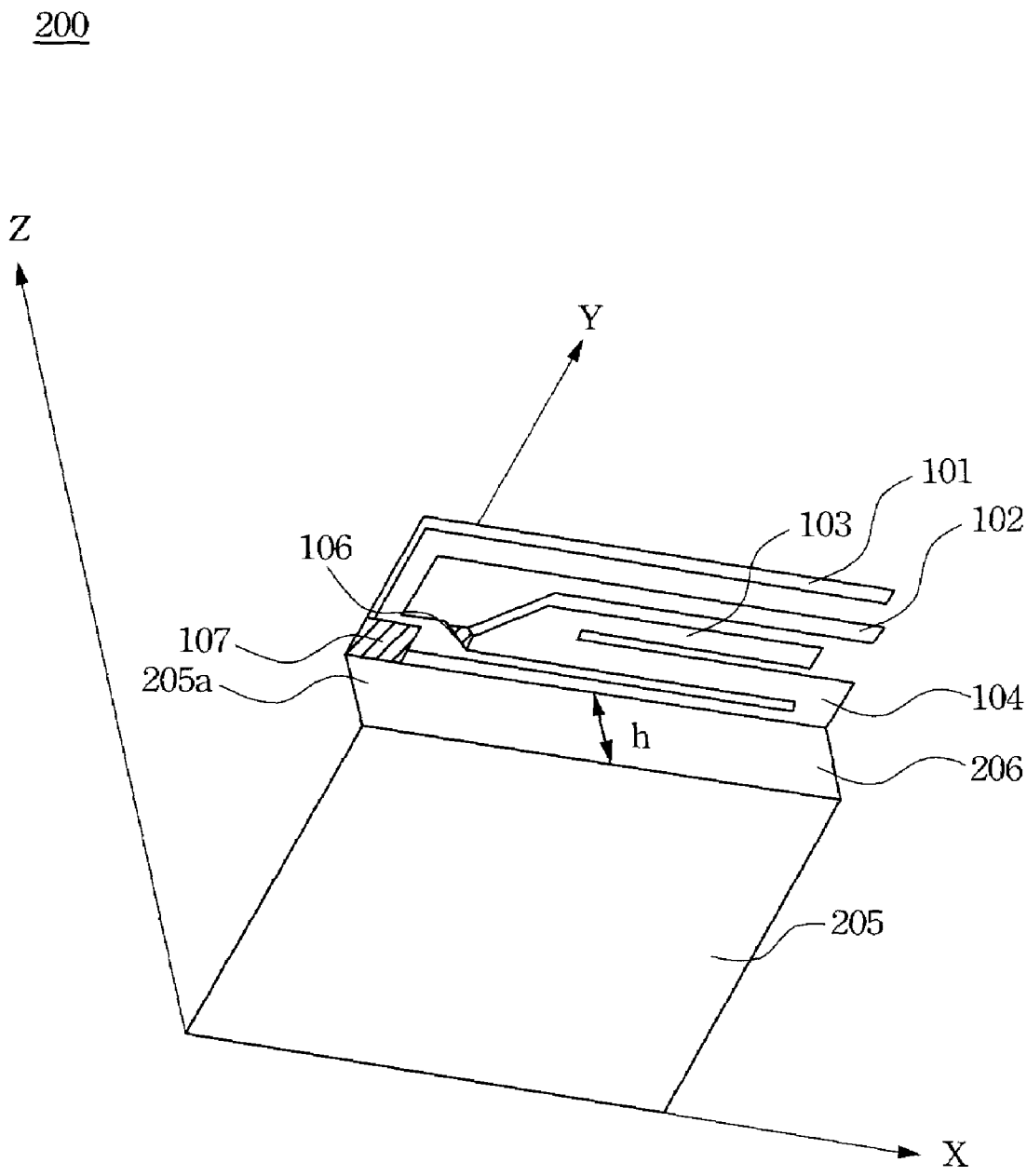
FIG. 8 is a schematic diagram of a multi-band antenna in accordance with a second preferred embodiment of the present invention.

FIG. 8 is a schematic diagram of a multi-band antenna in accordance with a second preferred embodiment of the present invention. The multi-band antenna 200 has a curved ground portion including a first ground surface 205 and a second ground surface 206. The parasitic unit 101, the first radiation portion 102, the second radiation portion 103 and the connection unit 104 connect with the first ground surface 205 through the second ground surface 206. The second ground surface 206 raises the plane in which the parasitic unit 101, the first radiation portion 102, the second radiation portion 103 and the connection unit 104 are located. Therefore, the multi-band antenna 200 has a step appearance. In an embodiment, the first ground surface 205 is perpendicular to the second ground surface 206. Therefore, the parasitic unit 101, the first radiation portion 102, the second radiation portion 103 and the connection unit 104 are raised a height of h from the second ground surface 206.

Figure 9:
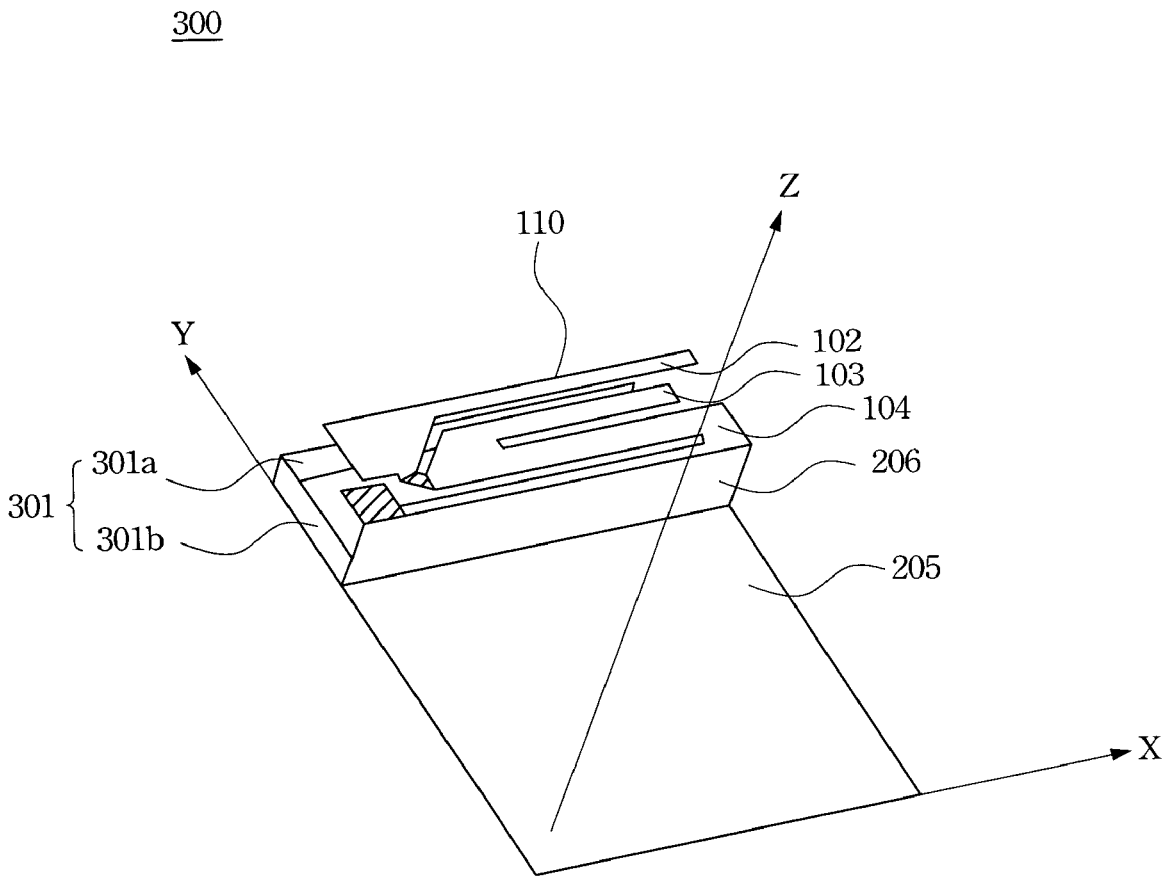
FIG. 9 is a schematic diagram of a multi-band antenna in accordance with a third preferred embodiment of the present invention.

FIG. 9 is a schematic diagram of a multi-band antenna in accordance with a third preferred embodiment of the present invention. The multi-band antenna 300 has a curved ground portion including a first ground surface 205 and a second ground surface 206. The first radiation portion 102, the second radiation portion 103 and the connection unit 104 connect with the first ground surface 205 through the second ground surface 206. The second ground surface 206 raises the plane in which the first radiation portion 102, the second radiation portion 103 and the connection unit 104 located. In this embodiment, the parasitic unit 301 extends from a side not connected with the second radiation portion 103 of the second ground surface 206. A cross section constructed by the parasitic unit 301 and the second ground surface 206 has an appearance similar to "U". The projection of the first radiation portion 102 and the second radiation portion 103 in the cross section is located in the range of the "U". In an embodiment, the parasitic unit 301 includes a first parasitic surface 301*a* and a second parasitic surface 301*b*. An included angle exists between the first parasitic surface 301*a* and the second parasitic surface 301*b*. The included angle is, for example, 90 degrees. A cross section constructed by the first parasitic surface 301*a*, the second parasitic surface 301*b* and the second ground surface 206 has an appearance similar to "U". According to this embodiment, the projection location of the top 110 of the first radiation portion 102 is equal or under the location of the first parasitic surface 301*a* in this cross section.

Figure 10:
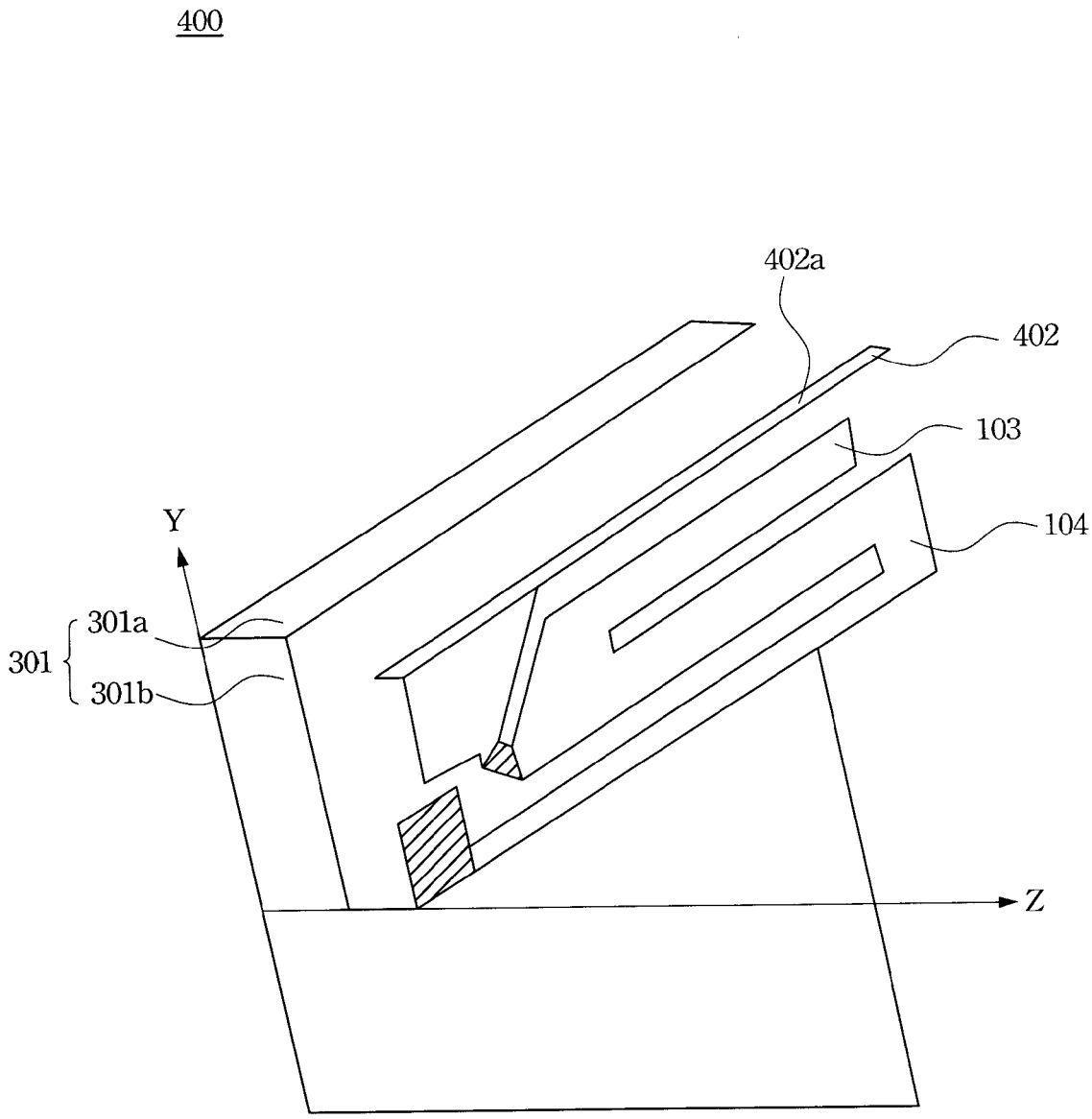
FIG. 10 is a schematic diagram of a multi-band antenna in accordance with a fourth preferred embodiment of the present invention.

FIG. 10 is a schematic diagram of a multi-band antenna in accordance with a fourth preferred embodiment of the present invention. The second radiation portion 103 and the connection unit 104 of the multi-band antenna 400 are located in a same plane. Partial first radiation portion 402 is bent toward the parasitic unit 301. Therefore, an included angle exists between the first radiation portion 402 and this plane. In an embodiment, the included angle is 90 degree. One surface 402*a* of the first radiation portion 402 faces the parasitic unit 301. The parasitic unit 301 includes a first parasitic surface 301*a* and a second parasitic surface 301*b*. A cross section constructed by the first parasitic surface 301*a*, the second parasitic surface 301*b* and the second ground surface 206 has an appearance similar to "U". According to this embodiment, the projection location of the surface 402*a* is equal or under the location of the first parasitic surface 301*a* in this cross section. Accordingly, the volume of the multi-band antenna 400 can be reduced. Moreover, the surface 402*a* is perpendicular to this cross section, therefore, the area of the first radiation portion 402 can be enlarged to increase the bandwidth.

Figure 11:
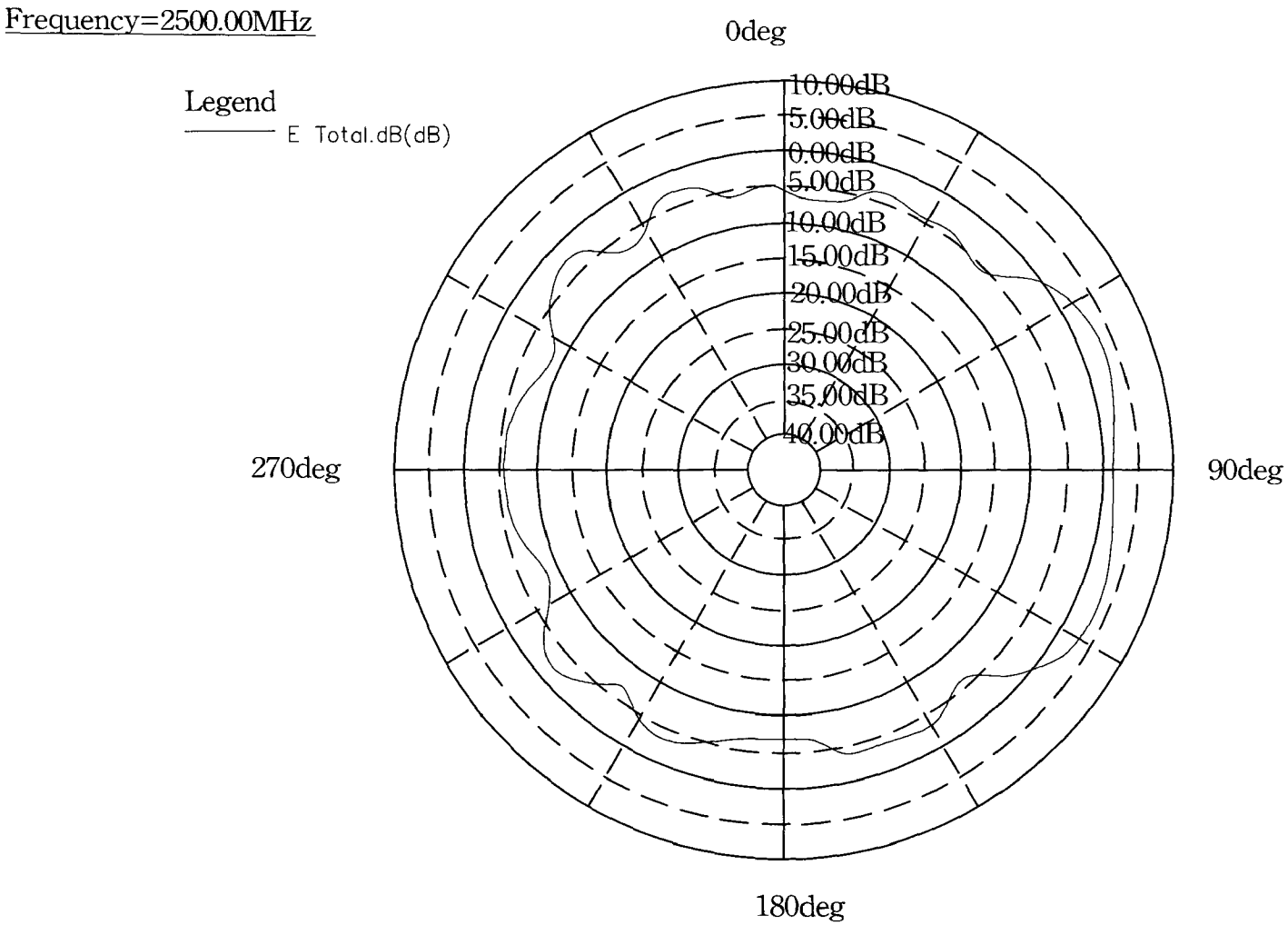
FIG. 11 to FIG. 13 are horizontally polarized principle plane radiation patterns of X-Y plane, Y-Z plane and X-Z plane respectively.
Figure 12:
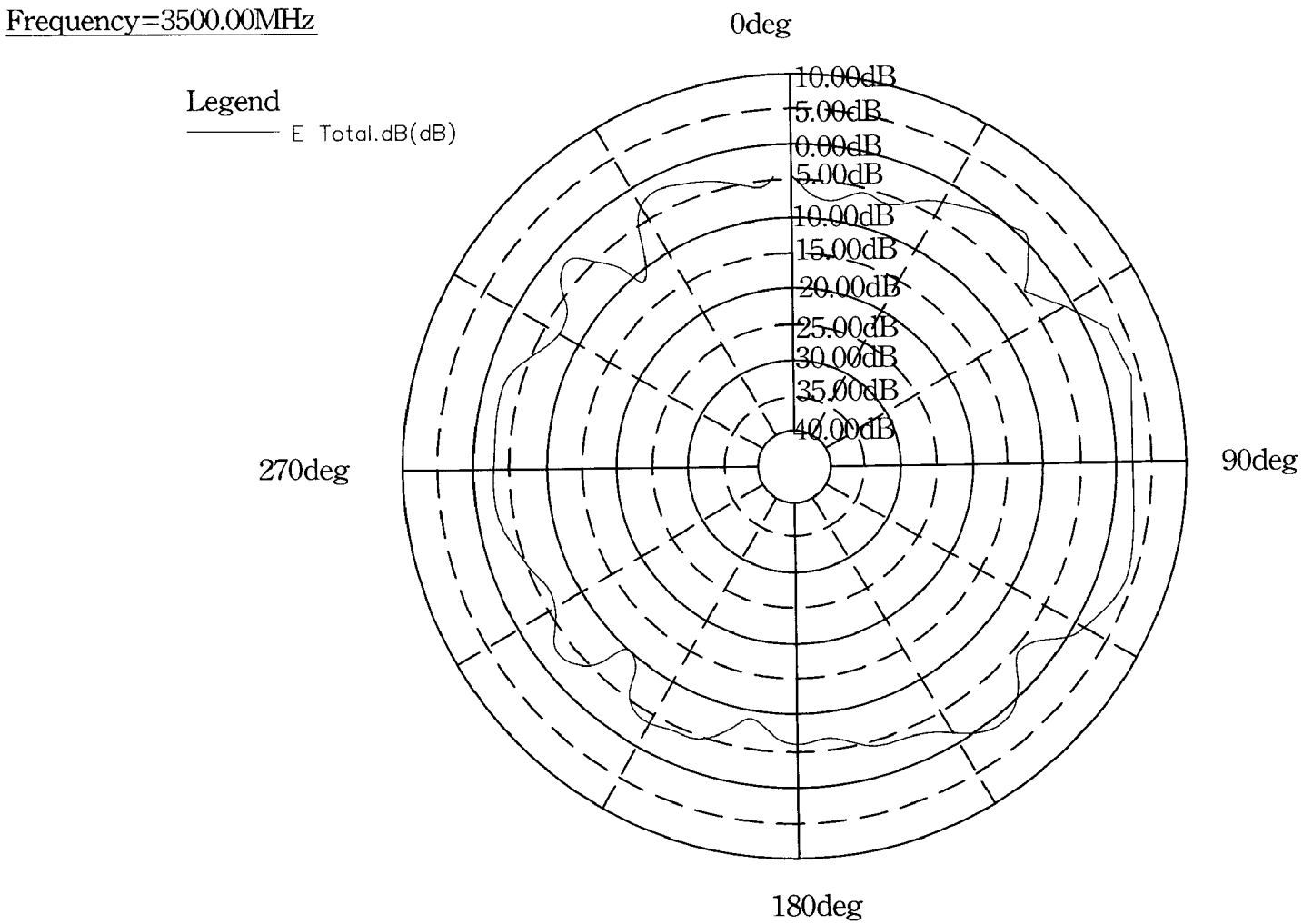
Figure 13:
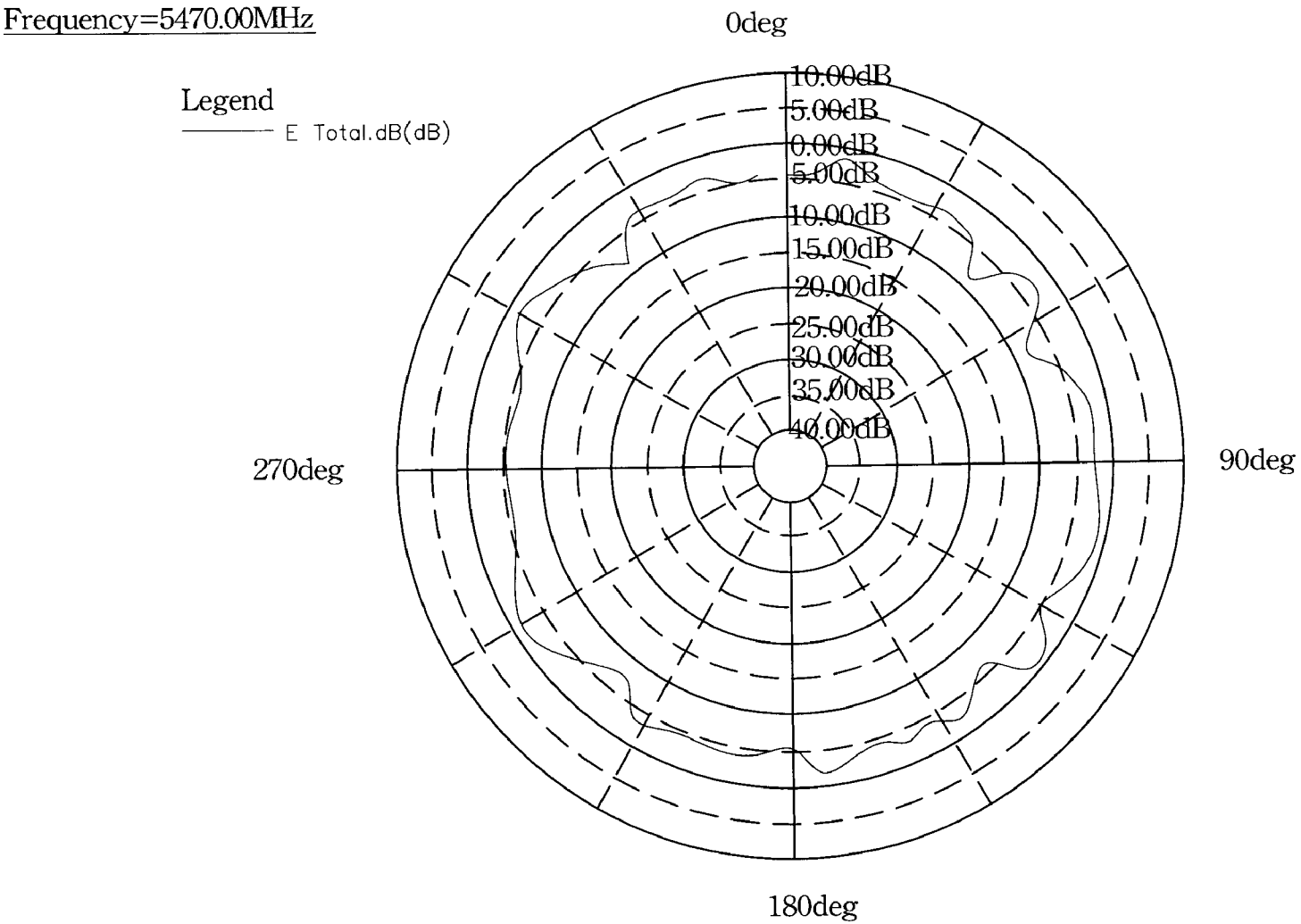

FIG. 11 to FIG. 13 are horizontally polarized principle plane radiation patterns of X-Y plane, Y-Z plane and X-Z plane respectively. Accordingly, the radiation patterns are average in each plane to realize the omni-directional requirements.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A multi-band antenna, comprising:

a ground portion;

a parasitic unit connecting with a side of the ground portion and operated at a first frequency band;

a first radiation portion having a feeding point and operated at a second frequency band; and a second radiation portion connecting with the feeding point and operated at a third frequency band, wherein the first radiation portion and the second radiation portion are located between the parasitic unit and the side of the ground portion, wherein the parasitic unit, the first radiation portion and the second radiation portion are located in a plane.

2. The multi-band antenna of claim 1, wherein the multi-band antenna further comprises a connection unit and the second radiation portion connects with the side of the ground portion through the connection unit.

3. The multi-band antenna of claim 1, wherein a cross section constructed by the parasitic unit and the side of the ground portion has an appearance of "U" whose opening is toward a specific direction.

4. The multi-band antenna of claim 3, current routes in the parasitic unit, the first radiation portion and the second radiation portion are arranged toward the specific direction.

5. The multi-band antenna of claim 1, wherein the ground portion includes a first ground surface and a second ground surface.

6. The multi-band antenna of claim 5, wherein the second ground surface raises a plane in which the parasitic unit, the first radiation portion and the second radiation portion are located.

7. The multi-band antenna of claim 5, wherein an included angle exists between the first ground surface and the second ground surface.

8. The multi-band antenna of claim 7, wherein the included angle is 90 degrees.

9. The multi-band antenna of claim 1, wherein the parasitic unit includes a first part and a second part, the first part is parallel to the side and connects with the side through the second part.

10. The multi-band antenna of claim 1, wherein the first radiation portion includes a third part and a fourth part, the third part is parallel to the side and connects with the feeding point through the fourth part.

11. The multi-band antenna of claim 1, wherein the second radiation portion includes a fifth part and a sixth part, the fifth part is parallel to the side and connects with the feeding point through the sixth part.

12. The multi-band antenna of claim 1, wherein the first frequency band is between 2.3 GHz and 2.7 GHz.

13. The multi-band antenna of claim 1, wherein the second frequency band is between 3.3 GHz and 3.8 GHz.

14. The multi-band antenna of claim 1, wherein the third frequency band is between 5.15 GHz and 5.85 GHz.

15. The multi-band antenna of claim 1, wherein the first frequency band and the second frequency band can be merged together to form a fourth frequency band by modifying the size of the parasitic unit and/or the first radiation portion, a bandwidth of the fourth frequency band is larger than that of the first frequency band and the second frequency band.

16. A multi-band antenna, comprising:

a ground portion having a first ground surface and a second ground surface;

a parasitic unit connecting with a first side of the second ground surface and operated at a first frequency band;

a first radiation portion having a feeding point and operated at a second frequency band; and a second radiation portion connecting with the feeding point and a second side of the second ground surface and operated at a third frequency band, wherein the first side is adjacent with the second side and the second ground surface raises a plane in which the parasitic unit, the first radiation portion and the second radiation portion are located, wherein a cross section constructed by the parasitic unit and the second ground surface has an appearance of "U", a projection location of the first radiation portion and the second radiation portion is located in the "U" appearance.

17. The multi-band antenna of claim 16, wherein the second radiation portion connects with the second side through a connection unit.

18. The multi-band antenna of claim 16, wherein the parasitic unit includes a first parasitic surface and a second parasitic surface, the first parasitic surface connects with the first side through the second parasitic surface, the projection location of the first radiation portion does not exceed the location of the first parasitic surface in this cross section.

19. The multi-band antenna of claim 18, wherein the first parasitic surface is parallel to the second ground surface.

20. The multi-band antenna of claim 18, wherein the first parasitic surface and the second parasitic surface have an included angle.

21. The multi-band antenna of claim 18, wherein the included angle is 90 degrees.

22. The multi-band antenna of claim 18, wherein current routes in the parasitic unit, the first radiation portion and the second radiation portion are arranged toward a same direction.

23. The multi-band antenna of claim 16, wherein the first radiation portion includes a first part and a second part, the first part is parallel to the second side and connects with the feeding point through the second part.

24. The multi-band antenna of claim 23, wherein an included angle exists between the first part and the second part to make the first part bend to the parasitic unit.

25. The multi-band antenna of claim 24, wherein the included angle is 90 degrees, the first part is parallel to the parasitic unit.

26. The multi-band antenna of claim 24, wherein the projection location of the first part is equal or under the location of the parasitic unit in this cross section.

27. The multi-band antenna of claim 16, wherein the second radiation portion includes a third part and a fourth part, the third part is parallel to the second side and connects with the feeding point through the fourth part.

28. The multi-band antenna of claim 16, wherein the first frequency band is between 2.3 GHz and 2.7 GHz.

29. The multi-band antenna of claim 16, wherein the second frequency band is between 3.3 GHz and 3.8 GHz.

30. The multi-band antenna of claim 16, wherein the third frequency band is between 5.15 GHz and 5.85 GHz.

31. The multi-band antenna of claim 16, wherein the first frequency band and the second frequency band can be merged together to form a fourth frequency band by modifying the size of the parasitic unit and/or the first radiation portion, a bandwidth of the fourth frequency band is larger than that of the first frequency band and the second frequency band.

32. The multi-band antenna of claim 16, wherein an included angle exists between the first ground surface and the second ground surface.

33. The multi-band antenna of claim 16, wherein the included angle is 90 degrees.

* * * * *